US005405669A

United States Patent [19]

Lidar

[11] Patent Number: 5,405,669

[45] Date of Patent: Apr. 11, 1995

[54] SEAM FOR FABRICS

[75] Inventor: Per-Ola Lidar, Högsjö , Sweden

[73] Assignee: Scandiafelt AB, Högsjö , Sweden

[21] Appl. No.: 108,703

[22] PCT Filed: Sep. 28, 1992

[86] PCT No.: PCT/SE92/00126

§ 371 Date: Sep. 7, 1993

§ 102(e) Date: Sep. 7, 1993

[87] PCT Pub. No.: WO92/15743

PCT Pub. Date: Sep. 17, 1992

[30] Foreign Application Priority Data

Mar. 5, 1991 [SE] Sweden ..... 9100645

[51] Int. Cl.[6] ..... F16G 3/02

[52] U.S. Cl. ..... 428/58; 24/33 P; 156/158; 162/900; 198/844.2; 245/10; 428/193

[58] Field of Search ..... 24/33 P; 156/158; 162/900; 198/844.2; 245/10; 428/58, 193

[56] References Cited

U.S. PATENT DOCUMENTS

| | | | |
|---|---|---|---|
| 4,026,331 | 5/1977 | Lees et al. | 139/383 A |
| 4,658,863 | 4/1987 | Errecart | 139/383 A |
| 4,695,015 | 9/1987 | Salminen | 245/6 |
| 4,775,446 | 10/1988 | Eschman | 162/348 |
| 4,938,269 | 7/1990 | Nicholas et al. | 428/58 |
| 5,188,884 | 2/1993 | Smith | 428/192 |
| 5,204,150 | 4/1993 | Davenport | 428/58 |

FOREIGN PATENT DOCUMENTS

| | | |
|---|---|---|
| 1520478 | 3/1968 | France . |
| 2126995 | 1/1973 | Germany . |
| 3633395 | 7/1989 | Germany . |
| 416482 | 1/1981 | Sweden . |
| 463424 | 11/1990 | Sweden . |

*Primary Examiner*—James C. Cannon
*Attorney, Agent, or Firm*—Jacobson, Price, Holman & Stern

[57] ABSTRACT

Joints for industrial fabrics are made such that the end edge of each part of the fabric is formed with projecting loops (5), which are formed by bending the warp threads of each part backwards, the return parts of these threads being woven into the fabric for a given length. The loops of one part are inserted between the loops in the opposite part for being fixed in this position. It is desirable that all warp threads in the fabric can coact in the joint, even if their collective width is greater than 100% of the fabric width. The individual loops (5) along at least some portion of the end edges (3, 4) of the parts (1, 2) are therefore formed from at least two juxtaposed threads (7, 8; 11, 12) crossing each other at least once (at 9) before the point of return into the fabric.

7 Claims, 1 Drawing Sheet

SEAM FOR FABRICS

BACKGROUND OF THE INVENTION

The present invention relates to a joint for industrial fabrics where each part of the fabric is formed with projecting loops formed by bending backwards the warp threads of the fabric, the return portions of these threads being reinserted in the weave for a given distance, the loops in one part of the joint being inserted between the loops in the opposite part for fixing in this position.

Examples of specifications which describe joints of the kind mentioned above are SE 7510836-5, SE 330825 and U.S. Pat. No. 4,658,863. The loops are normally fixed in their juxtaposed positions by a thread being inserted through all the loops and thus transverse the longitudinal direction of the fabric. A problem in joints of this kind is that all the warp threads in the fabric cannot be used to form loops when the collected width of the threads exceeds about 90% of the width of the fabric. The explanation for this is that it is not possible to obtain a sufficiently wide space between the loops for permitting the insertion of loops from the opposing fabric edge between these loops. This problem has been solved in different ways, inter alia by having only alternate threads forming loops, while intermediate threads have been cut off or returned into the weave without forming free loops. There has also been the procedure of forming loops at different distances from the end edge so that two or three rows of loops are formed, for example, where each row of loops is connected by a locking filament, e.g. according to U.S. Pat. No. 4,658,863.

SUMMARY OF THE INVENTION

The object of the present invention is to achieve a joint where all the warp threads in the fabric can coact in the joint even if their collected width is greater than 100% of the fabric width. By means of the invention, there is further achieved that there is a locking action in the longitudinal direction of the fabric without such as a locking filament being inserted through the loops. In most cases this radically simplifies making the joint, but also gives the possibility of using other fixing methods of the fabric parts other than the one using a locking filament. Tape can be used, for example. In addition, the advantage can be achieved that by the configuration of the loops space is provided between them that can be used for purposes other than making the joint.

The distinguishing features of the invention solving the above mentioned problem and providing the mentioned advantages will be apparent from the characterising portions of the following claims.

BRIEF DESCRIPTION OF THE DRAWINGS

An embodiment of the invention will now be described with reference to the accompanying drawing figures, while variations of the invention will be described without reference to drawing figures.

Figure 1:
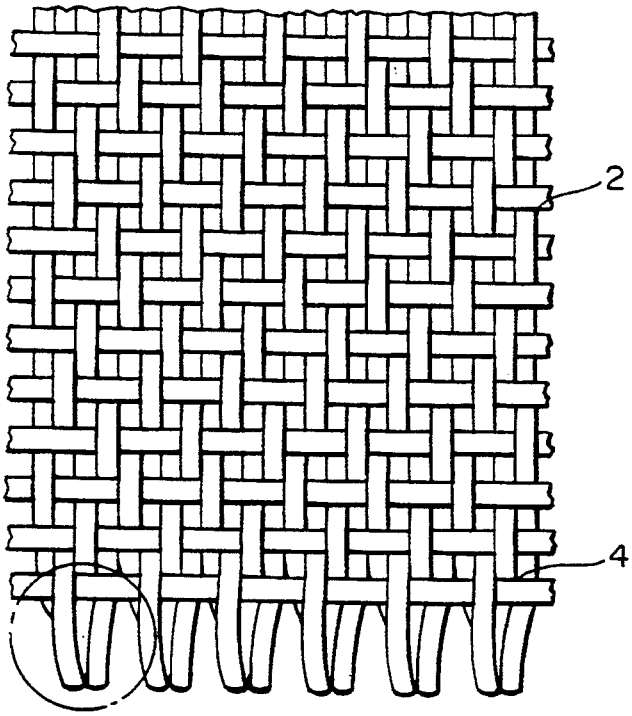
FIG. 1 shows a part of a woven fabric.
Figure 1A:
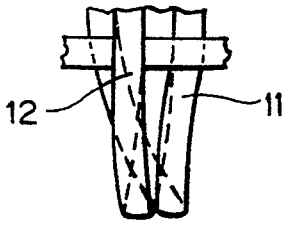
FIG. 1*a* shows an enlargement of the encircled area of FIG. 1.
Figure 2:
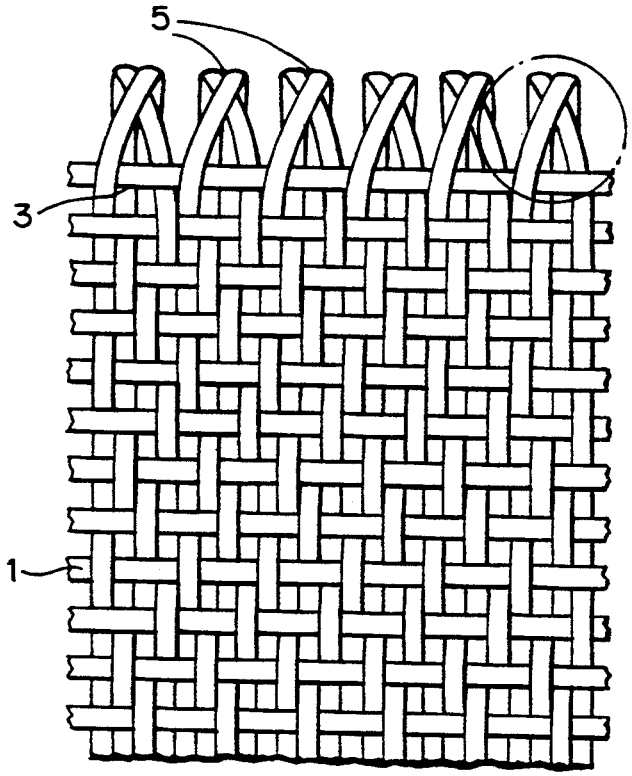
FIG. 2 shows another part of a woven fabric.

Two parts 1 and 2 of a woven fabric are illustrated in FIGS. 1 and 2. These parts are united at their end edges so that the fabric becomes endless. To achieve this both end edges 3 and 4 are moved in towards each other. The part 1 of the fabric has loops 5 formed outside the fabric edge 3. Each loop 5 is formed by two warp threads 7 and 8 which cross over each other once at a point 9 lying spaced from the tip or point of return of the loop. This will be seen from FIG. 1*a*. After the warp threads 7 and 8 have crossed each other and have been bent into loops they are returned into the fabric and woven together with the weft threads or fixed in some other way. By the warp threads 7 and 8 being crossed, i. e. all warp threads being crossed in pairs to form loops, the space between the loops is enlarged, or there is at least obtained enlarged spaces between the loops of the upwardly facing part of the space between the loops in FIG. 1*a*.

Figure 2A:
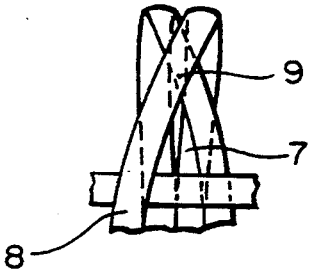
FIG. 2*a* shows an enlargement of the encircled area of FIG. 2.

At the end edge 4 of the other fabric part the loops are formed in a corresponding manner, but with the difference that the warp threads 11,12 have been caused to cross each other on the underside of the fabric, and have been returned to its upper side as illustrated in FIG. 2*a*. When the end edge 3 is moved towards the end edge 4 the loops are inserted between each other preferably such that the loops in the end edge 4 are inserted from above seen in the plane of the drawing FIG. 7, between the loops at the end edge 3, the spaces formed by the crossing threads being utilised by crossing threads in the opposing part. Since these spaces are cuneiform, with the thinnest dimension closest to the edge of the weave, this signifies that there is a certain locking action between parts 1 and 2 in the plane of the fabric. Final fixation of the loops in their meshing positions preferably takes place with the aid of a filament which is taken through all the loops and is thus transverse the fabric.

As will be apparent from the above description, the crossover points of the paired warp threads are all on the same side of the fabric for its one part, but on the other side of it for the other part. In addition, it will be noted that the crossover point comes before the tip of the loop thus formed, but in a preferred embodiment the crossover point is at the actual tip. It is also possible to arrange more than one crossover point and thus twine two threads before the tip of the loop. The availability of twining more than two threads so that the threads have a plurality of crossover points before the tip of the loop is not neglected either.

A further, unillustrated variation of the invention is that in the case when more than two threads form a loop, the threads are plaited or intertwined according to some pattern before the tip of the loop. A still further modification is that the warp threads are flattened, at least in the region where the loops are formed, so that the relationship between the height and width of the cross sectional shape of the thread is less than 1.

In the introduction it has been mentioned that if the collective width of the warp threads exceeds about 90% of the fabric width, all the warp threads cannot participate in the loop joint. This means that it will be necessary to bend every alternate thread, for example, and return it into the weave before it comes sufficiently far out to form a loop outside the end edge of the fabric. If it is the case, even so, that the fabric width is sufficient for all threads to be formed into loops without the invention needing to be utilized, it may be imagined that in some cases the spaces between the loops must be enlarged, e.g. for insertion of a reinforcing thread or some other thread, and it is suitable that this thread participates in the loop joint. In such cases the invention can be utilized so that all threads or some of the threads cross each other in pairs to give the possibility of forming a loop for the further thread which is woven in, and which may thus even have a greater diameter than the normal threads and still participate in the loop joint.

I claim:

1. A joint for industrial fabrics where the end edge of each part is formed with projecting loops by bending back the warp threads of the fabric, these threads being woven into the fabric for a given length, the loops of the one part being inserted between the loops in the opposing part for fixation in this position, characterized in that the individual loops along at least some part of the end edges of the parts are formed by at least two juxtaposed threads which cross each other at least once before the point of return into the fabric.

2. The joint as claimed in claim 1, characterized in that the crossover points for all loops in one part are on the same side of the fabric and are on the opposite side of the fabric for the other part.

3. The joint as claimed in claim 1, characterized in that the crossover points are at the tips of the loops.

4. The joint as claimed in either of claim 1, characterized in that crossing threads are intertwined from one direction up to the tip of the loop.

5. The joint as claimed in claim 1, at least three threads forming a loop, characterized in that the threads are plaited together up to the tip of the loop from one direction of the loop.

6. The joint as claimed in claim 1, characterized in that the warp threads have a cross-sectional shape, at least in the extension forming the loops, where the ratio between height and width of the thread is less than 1.

7. The joint as claimed in claim 1, the number of warp threads per unit length of width of the fabric being such that there is sufficient space between the set of loops on each part for insertion of the sets of loops between each other, characterized in that some of the loops are formed by crossing threads to give space to loops formed by extra thick warp threads.

* * * * *

UNITED STATES PATENT AND TRADEMARK OFFICE

CERTIFICATE OF CORRECTION

PATENT NO. : 5,405,669
DATED : April 11, 1995
INVENTOR(S) : Per-Ola LIDAR

It is certified that error appears in the above-indentified patent and that said Letters Patent is hereby corrected as shown below:

On title page, item [22], "Sep. 28, 1992"
should read --Feb. 28, 1992--.

Signed and Sealed this

Twenty-ninth Day of August, 1995

*Attest:*

BRUCE LEHMAN

*Attesting Officer*

*Commissioner of Patents and Trademarks*